US010118753B2

(12) United States Patent
Martin

(10) Patent No.: US 10,118,753 B2
(45) Date of Patent: Nov. 6, 2018

(54) METERING VALVE

(71) Applicant: James H. Martin, Burr Ridge, IL (US)

(72) Inventor: James H. Martin, Burr Ridge, IL (US)

( * ) Notice: Subject to any disclaimer, the term of this patent is extended or adjusted under 35 U.S.C. 154(b) by 208 days.

(21) Appl. No.: 15/289,551

(22) Filed: Oct. 10, 2016

(65) Prior Publication Data

US 2017/0021993 A1 Jan. 26, 2017

Related U.S. Application Data

(62) Division of application No. 13/962,077, filed on Aug. 8, 2013, now Pat. No. 9,527,658.

(51) Int. Cl.

| | |
|---|---|
| ***B65B 31/00*** | (2006.01) |
| ***B65D 83/42*** | (2006.01) |
| ***B65D 83/54*** | (2006.01) |
| ***B65D 83/62*** | (2006.01) |

(52) U.S. Cl.

CPC ..... *B65D 83/425* (2013.01); *B65D 83/42* (2013.01); *B65D 83/546* (2013.01); *B65D 83/62* (2013.01)

(58) Field of Classification Search

CPC ..... B65B 83/425; B65B 83/42

See application file for complete search history.

(56) References Cited

U.S. PATENT DOCUMENTS 5,105,995 A * 4/1992 Martin ..... B65D 83/54 128/200.14

* cited by examiner

*Primary Examiner* — Jason K Niesz

(74) *Attorney, Agent, or Firm* — Law Office of John W. Harbst

(57) ABSTRACT

A metering valve having an elongate moveable stem arranged for axial movements within a container and defining a discharge passage. A flexible bag for containing a liquid formulation to be dispensed from the metering valve surrounds a lower end of the metering valve. The bag is fillable through a fill passage defined by the valve and from an exterior of the container. A one-way valve, disposed in operable combination with the fill passage, prevents liquid formulation in the bag from escaping to ambient through the fill passage but allows the bag to be filled after the lower end of the valve and the bag are inserted into the container and the container is pressurized with a propellant.

17 Claims, 13 Drawing Sheets

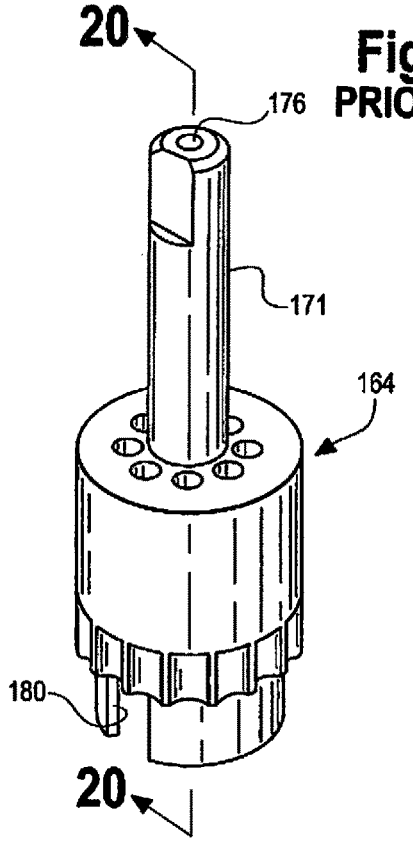
Fig. 19
PRIOR ART
Fig. 20
PRIOR ART
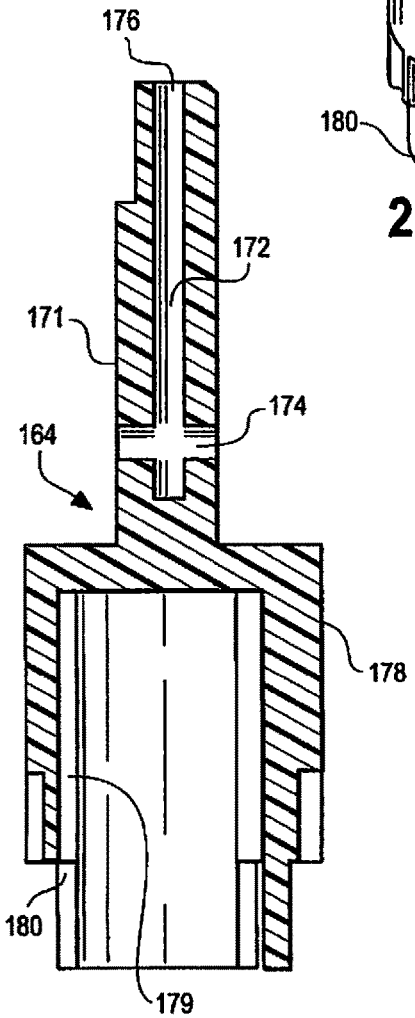
Fig. 21
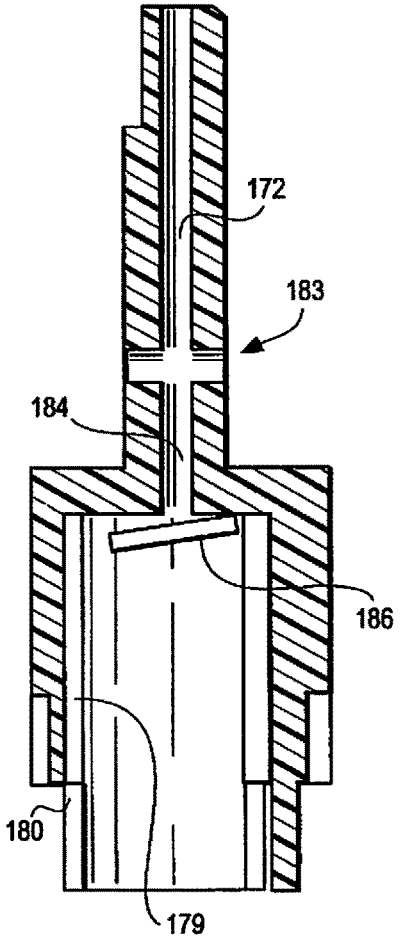

METERING VALVE

CROSS REFERENCE TO RELATED APPLICATIONS

This patent application is a divisional patent application to my copending U.S. patent application Ser. No. 13/962,077 which is now U.S. Pat. No. 9,527,658 filed on Aug. 8, 2013 and which claims priority to U.S. provisional patent application Ser. No. 61/680,911, filed Aug. 8, 2012; the full disclosures of each being incorporated herein by reference.

FIELD OF THE INVENTION DISCLOSURE

The present invention disclosure relates to a dispensing apparatus including a valve for dispensing liquid formulation from a container and structure for permitting the container to be filled or replenished with liquid formulation from outside the container.

BACKGROUND

Unit dose dispensers, or dispensers having metering valves that discharge predetermined volumes of liquefied formulation art known in the art. Where the formulation includes medication for certain specific purposes, such as medication for use in nasal passages and the like, a metering valve that discharges fixed volumes of each medication at each discharge is desired. Several such valves are disclosed in the following references: U.S. Pat. Nos. 4,892,232; 5,105,995; 5,085,351; 5,183,187; 5,484,088; 6,695,175; and, 6,910,606.

Existing metering valves discharge liquefied formulation from a pressurized container filled either prior to attaching the valve or dispensing apparatus at the upper end of the container, or through a port at the bottom of the container. It is often desirable, however, to fill the formulation through the dispensing valve or apparatus. For example, formulations that include an evaporant, such as needed to create a mist or foam, are retained in a bag within the container, with the bag being surrounded in the container by a propellant. As such, the propellant pressurizes the bag thereby retaining the liquefied formulation or gas in a liquid state.

It should be noted, existing adjustable metering valves are not suitable for discharging a formulation that includes a liquefied gas that is retained in liquid form by the propellant. This is because the liquefied evaporant turns to gas as soon as the valve opens the metering chamber to ambient thereby causing all the formulation in the metering chamber, not just that portion adjacent a movable wall of the metering chamber, to be discharged through the valve. Those unit dose valves that are not adjustable, however, can discharge a fixed amount formulation, including an evaporant, on each depression or actuation of the dispensing structure.

In order for such a metering valve to discharge a formulation that includes a liquefied gas, the formulation must be maintained under pressure while it is being inserted into the bag within the container. The bag must therefore have a single port through which the contents thereof are both filled and discharged. That is, the bag in the container must be filled through the dispensing structure which extends into the bag. Although all metering valves release a predetermined volume of formulation on each actuation of the dispensing structure, such known valves do not permit filing of the formulation through a stem of the valve.

U.S. Pat. No. 3,104,785 to Beard discloses a metering valve that can be filled through the stem of the valve and discharges a fixed amount of formulation on each actuation of the dispensing apparatus. The '785 Beard device, however, inconveniently requires the dispensing stem to be in a depressed condition at the time the liquid formation is filled through the metering valve.

Thus, there a need and continuing desire for an improved metering valve that dispenses a volume of liquid formulation from a bag upon each actuation of the dispensing apparatus and which allows the bag in the container to be replenished from outside the container.

BRIEF DESCRIPTION

Briefly, the present invention disclosure is embodied in a dispensing device including a container with an aperture and a metering valve having one end fitted in the aperture. In one form, the metering valve is of the type that dispenses a predetermined volume of liquid formulation on each discharge and has an elongate body with an upper end that extends to ambient and a lower end that extends into the container. In one form, the container includes a bag that surrounds and encloses the lower end of the metering valve into which the formulation to be discharged is inserted. Also within the container is a propellant that surrounds and serves to compresses the bag so as to force liquid formulation into a metering chamber in the valve. The valve also includes an axially elongated stem defining a discharge passageway therein. The stem is movable from an upward position, wherein the discharge passageway in the stem is closed off from the metering chamber, and a lowered position, wherein the discharge passageway in the stem communicates with the metering chamber to allow a fixed volume of formulation in the metering chamber to be discharged through the stem. In one form, structure toward the lower end of the stem allows liquid in the bag to fill the metering chamber when the stem is in the upward position.

In accordance with the present invention disclosure, a fill passage is provided in the metering valve. A one-way valve structure is arranged in operable combination with the fill passage so as to permit liquid formulation to be injected into the bag from outside of the container while preventing the liquid formulation in the container from escaping out the fill passage to ambient.

BRIEF DESCRIPTION OF THE DRAWINGS

FIG. 19 is a perspective view of a stem for the valve shown in FIGS. 17 and 18;

FIG. 20 is a longitudinal cross-sectional view of the stem illustrated in FIG. 19;

FIG. 21 is a cross-sectional view of the a replacement stem similar to the stem shown in FIG. 20 but having principals and teachings of this invention disclosure applied thereto;

DETAILED DESCRIPTION

Figure 1:
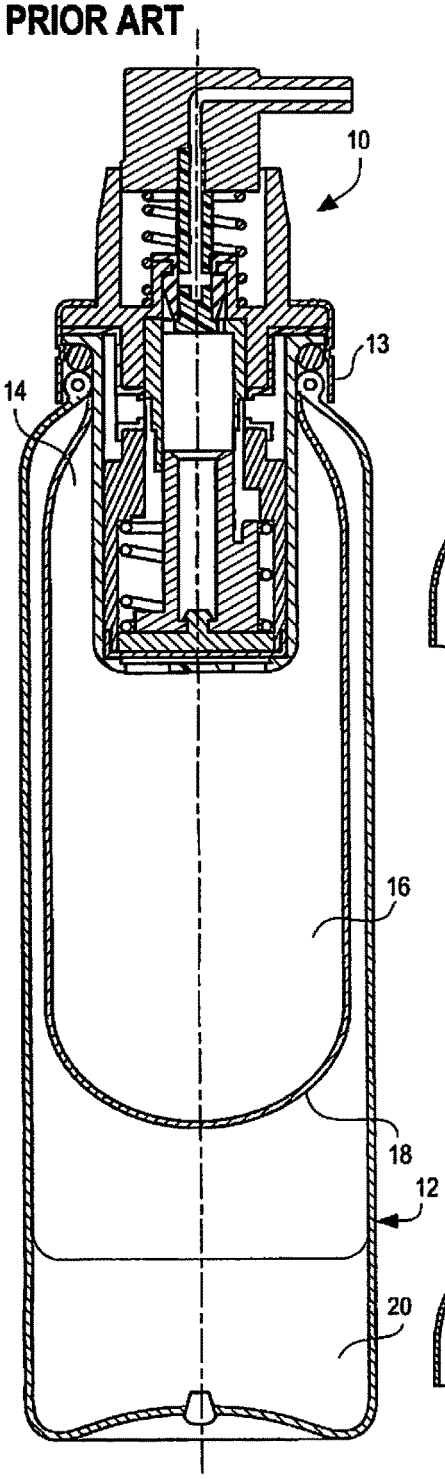
Fig. 1 PRIOR ART
FIG. 1 is a cross-sectional view of a dispensing device.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, there is shown in FIG. 1 a dispensing device that embodies principals and teachings of this invention disclosure and is generally designated by reference numeral 10. The dispensing device 10 includes a container 12 having an upper open end 13 into which is inserted a metering valve 14 with a moveable stem 15 for dispensing a fixed volume or amount of liquid formulation 16 that is retained within a flexible bag 18 inside the container 12. Also within the container 12, and surrounding the bag 18, is a propellant 20 that applies pressure to the bag 18 for expelling the formulation 16 through the metering valve 14. The axially moveable stem 15 actuates the valve when moved from an upper position to a lower position. Accordingly, on each actuation of the stem 15 a predetermined amount of the liquified formulation 16 is expelled through the passage in the stem.

It is sometimes necessary to maintain the formulation 16 under pressure while it is being injected into the bag 18. To do this, the formulation 16 must be inserted into the bag 18 after the propellant 20 has been injected into the container 12. This is to say, that the formulation 16 must be inserted through the metering valve 14.

Existing metering valves, in particular valves wherein the volume of liquid dispensed can be adjusted by the operator cannot be filled through the stem. The present invention disclosure is an improvement to existing metering valves and, therefore, the following will include a review of several existing metering valves and will describe the elements required to convert such valves so as to be fillable through the body of the valve and from outside of the container 12. Several types of dispensing devices are known in the art but all the various embodiments primarily relate to the design and construction of the valve 14, and, therefore, the other elements of the dispensing device 10, including the container 12, the formulation 16, the flexible bag 18, and the propellant 20 will all bear the same indicia numbers throughout the discussion of the various dispensing devices. The various known metering valves will be identified in the various drawings by reference numbers 14A, 14B, 14C and etc. Existing metering valves can generally be categorized into two groups. The first group of metering valves has a flexible membrane forming one wall of the metering chamber for the valve. The second group of metering valves utilizes a piston that forms one wall of the metering chamber for the valve.

FIGS. 2 through 6 illustrate a metering valve, generally indicated by reference numeral 14A, which embodies principals and teachings set forth in my U.S. Pat. No. 5,085,3521; the entirety of which is incorporated herein by reference. Since the majority of elements comprising valve 14A and their operation are disclosed in my U.S. Pat. No. 5,085,351, only those elements pertaining to the present invention disclosure will be described in detail.

Valve 14A includes a rigid tubular member 22, the outer surface of which has frusto-conical configuration and has a radial flange 24 toward the upper end thereof. The radial flange 24 extends around the central opening 13 of container 12. In this form, the tubular member 22 further defines a trapezoidal-shaped window 26 on the wall thereof. Window 26 opens into the central opening of member 22. Fitted around the circumference of the rigid tubular member 22 is a tubular flexible member 28 that also includes a radial flange 30 toward the upper end thereof. When valve 14A is assembled, the radial flange 30 is sandwiched between the flange 24 of member 22 and the opening 13 defined by container 12 and the parts are clamped together by a suitable retaining ring.

Axially moveable within the rigid tubular member 22 is an elongate stem 32 having an upper end 34, extending outward of the container 12 to the ambient, and a lower end 36, extending through the central opening of the rigid tubular member 22. In the illustrated embodiment, the upper end 34 of stem 32 is tubular with a passageway 37 therein. An upper end of passageway 37 opens to the ambient and a lower end opens to a transverse port 38 disposed proximately midway along the length of stem 32. Below the port 38 is an enlarged frusto-conical portion 40 having a plurality of radially spaced indentations 42A, 42B and 42C therein. In the illustrated embodiment, the indentation 42A recesses or indents only slightly into the frusto-conical surface 40 while indentation 42B recesses or indents somewhat greater into the frusto-conical surface 40 than indentation 42A while indentation 42C recesses or indents to a greater extent into the frusto-conical surface 40 than indentations 42A or 42B.

Figure 2:
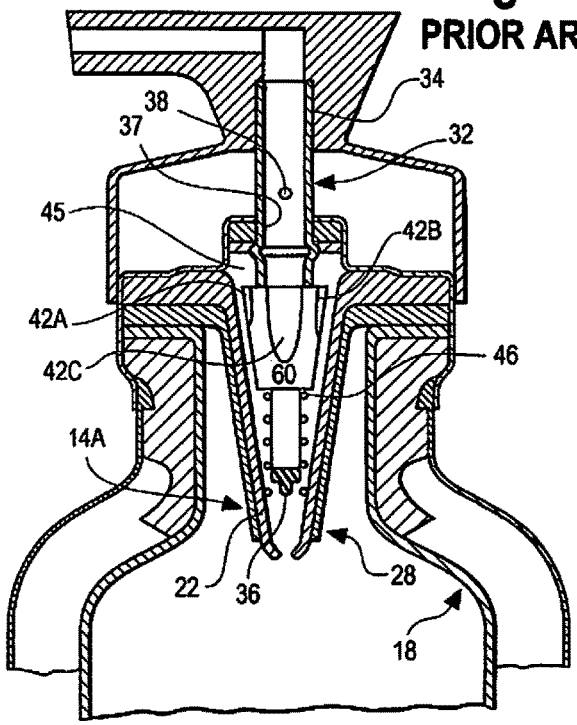
Fig. 2 PRIOR ART
FIG. 2 is an enlarged cross-sectional view of one form of a conventional valve having a stem in an elevated position.

In operation, stem 32 is vertically moveable through a tubular retainer 44 used to retain the valve 14A in opening 13. A lower surface of the retainer 44 defines an upper end of a metering chamber 45. The stem 32 is retained in an upward position (shown in FIG. 2) by a coil spring 46 when valve 14A is not dispensing a liquid formulation therefrom. As shown in FIG. 2, when in the raised position, the frusto-conical portion 40 of the stem 32 is spaced from the inner surface of the tubular member 22. The spacings around the tubular member 22 and below the tubular retainer 44 form the metering chamber 45 of valve 14A. Liquid formulation 16 from within the flexible bag 18 enters through the bottom opening of the tubular member 22 and fills chamber 45 while the stem 32 remains in the upward or raised orientation.

Figure 3:
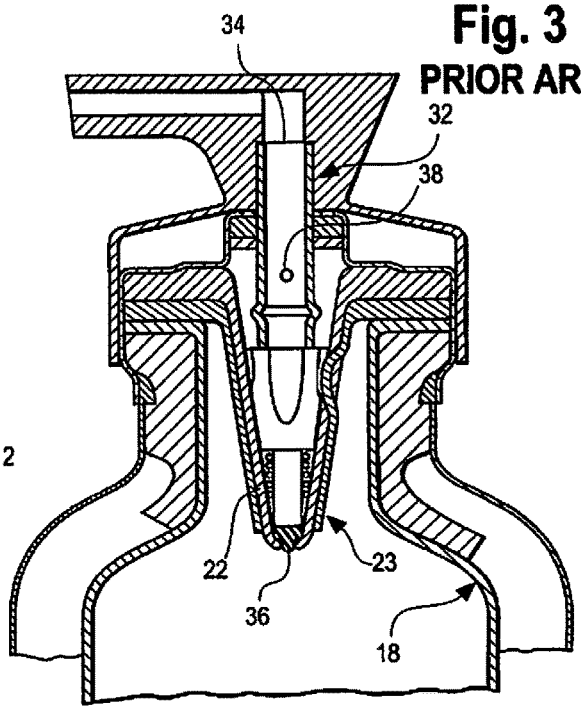
Fig. 3 PRIOR ART
FIG. 3 is another cross-section view of the conventional valve illustrated in FIG. 2 but showing the stem in a depressed position.
Figure 4:
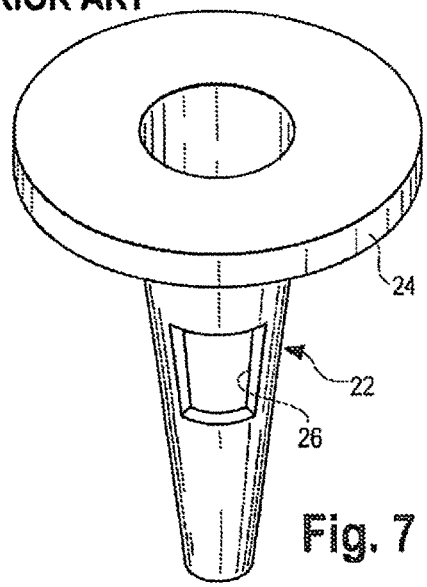
Fig. 4 PRIOR ART
FIG. 4 is an upper perspective view of a rigid member forming part of the valve illustrated in FIGS. 2 and 3.
Figure 5:
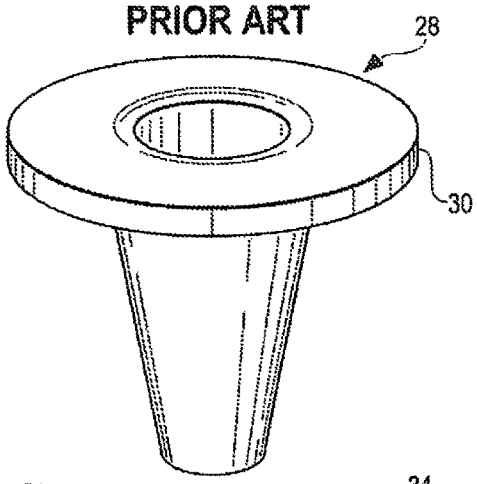
Fig. 5 PRIOR ART
FIG. 5 is a perspective view of a flexible member forming another part of the valve illustrated in FIGS. 2 and 3 and which is arranged in operable combination with the rigid member illustrated in FIG. 4.
Figure 6:
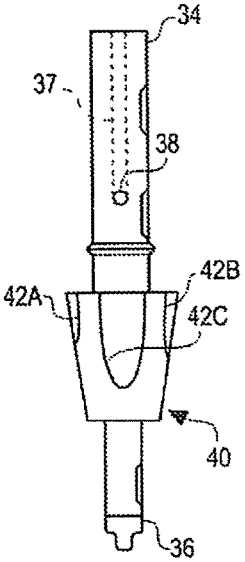
Fig. 6 PRIOR ART
FIG. 6 is a side elevational view of the valve stem shown in FIGS. 2 and 3.

To operate valve 14A, stem 32 is rotated until the indentation 42A, 42B, 42C for the desired dosage is oriented against the window 26 in the tubular member 22. When the stem 32 is depressed against of the spring 44, as shown in FIG. 3, the frusto-conical portion 40 on stem 32 moves axially downward and the outer surface thereof contacts the frusto-conically shaped inner surface of tubular member 22 to operably seal the chamber 45 from the interior of bag 18. At the same time, port 38 defined by stem 32 downwardly moves into chamber 45 and pressure, caused by the propellant 20, compresses the portion of the flexible member 28 adjacent the window 26 into the adjacent indentation 42A, 42B or 42C of the frusto-conical portion 40. As will be understood, compressing the flexible member 28 urges a predetermined amount or volume of the liquid formulation 16 into port 38 and, ultimately, through passageway 37 in the upper end of the stem 32 to the ambient. As will be appreciated, by rotating the stem 32 until the desired indentation 42A, 42B or 42C is operably positioned adjacent the window 26, it is possible to select the desired amount or volume of liquid formulation to be dispensed from valve 14A.

Figure 7:
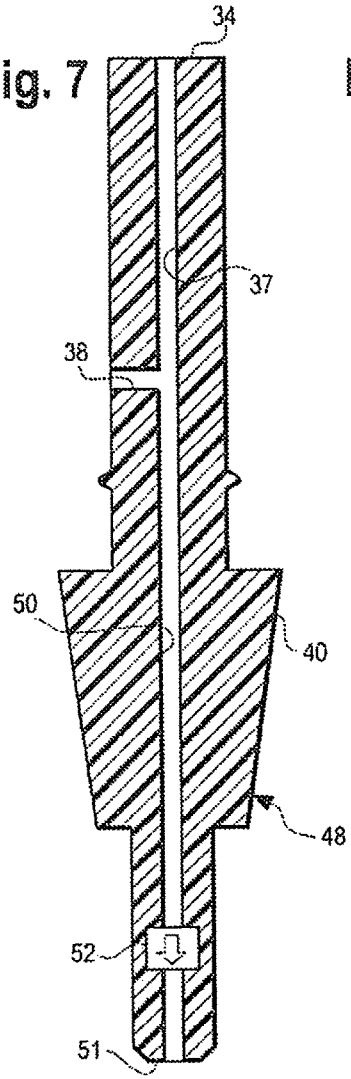
FIG. 7 is an enlarged cross-sectional view of one form of valve stem which can be used in operable combination with a valve of the type shown in FIGS. 2 and 3 and which embodies teachings and principals of this invention disclosure.

Notably, the valve 14A disclosed by way of example in FIG. 7 and disclosed in more detail in my U.S. Pat. No. 5,085,351 does not allow the liquid formulation in the container to be filled or replenished through the valve 14A. By replacing the stem 32 of valve 14A, with a replacement stem, generally indicated by reference numeral 48, however, the liquid formulation 16 in the bag 18 of the container 12 can easily and advantageously be replenished from an exterior of the container 12 and through the stem of the valve. Stem 48 is substantially identical to stem 32 as described above except that stem 42 defines a second passage 50 having an upper end that communicates with the dispensing passage 37. Toward a lower end 51, stem 48 has a one-way valve structure 52 that allows liquid formulation to flow downward from the upper passage 37 of the stem 48, through the passage 50 to the lower end 51 of stem 48 and into the bag 18, but does not allow liquid formulation to flow in a reverse direction, that is, the valve structure 52 will not allow liquid formulation to flow from bag 18 into the lower end 51 of stem 48 and into the passage 37.

Figure 8:
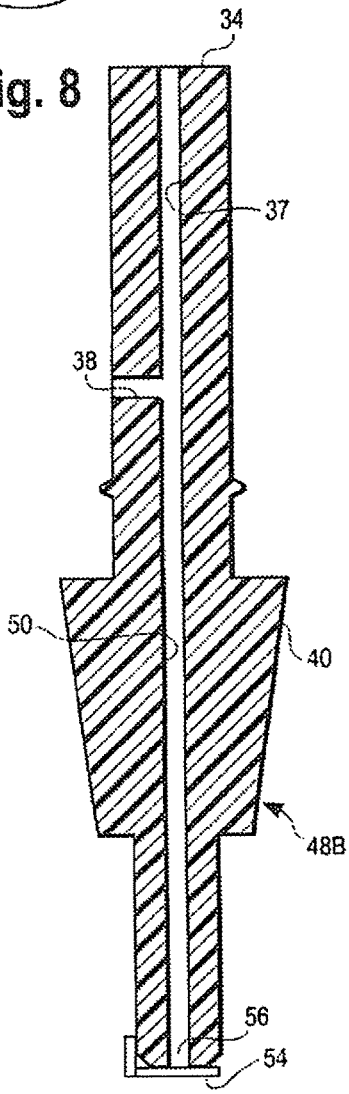
FIG. 8 is an enlarged cross-sectional view similar to FIG. 7 but showing another form of valve stem which can be used in operable combination with a valve of the type shown in FIGS. 2 and 3 and which embodies teachings and principals of this invention disclosure.

FIG. 8 illustrates an alternative or modified stem 48A for valve 14A. In the embodiment illustrated by way of example in FIG. 8, the one-way valve structure for preventing the flow of liquid formulation from the lower end 51 of stem 48A to the upper end and into the passage 37 is in the form of a flexible flap or reed valve 54 that extends across the opening in the lower end 51 of the stem 48A. The flap 54 is retained against the opening 56 leading into passage 50 to thereby block or prevent liquid formulation in the container from entering the passage 50. When pressurized liquid formulation is forced into the open upper end 34 of the stem 48A and through the passage 50, the pressurized liquid formulation will forcibly urge the flap out of the way and allow liquid to enter the bag 18 to thereby fill or refill the dispenser from outside the container 12. When the container 12 is not being filled, the pressurized fluid or liquid formulation in the bag 18 will act to press the flap 54 against and close the opening 56 to passage 50.

Figure 9:
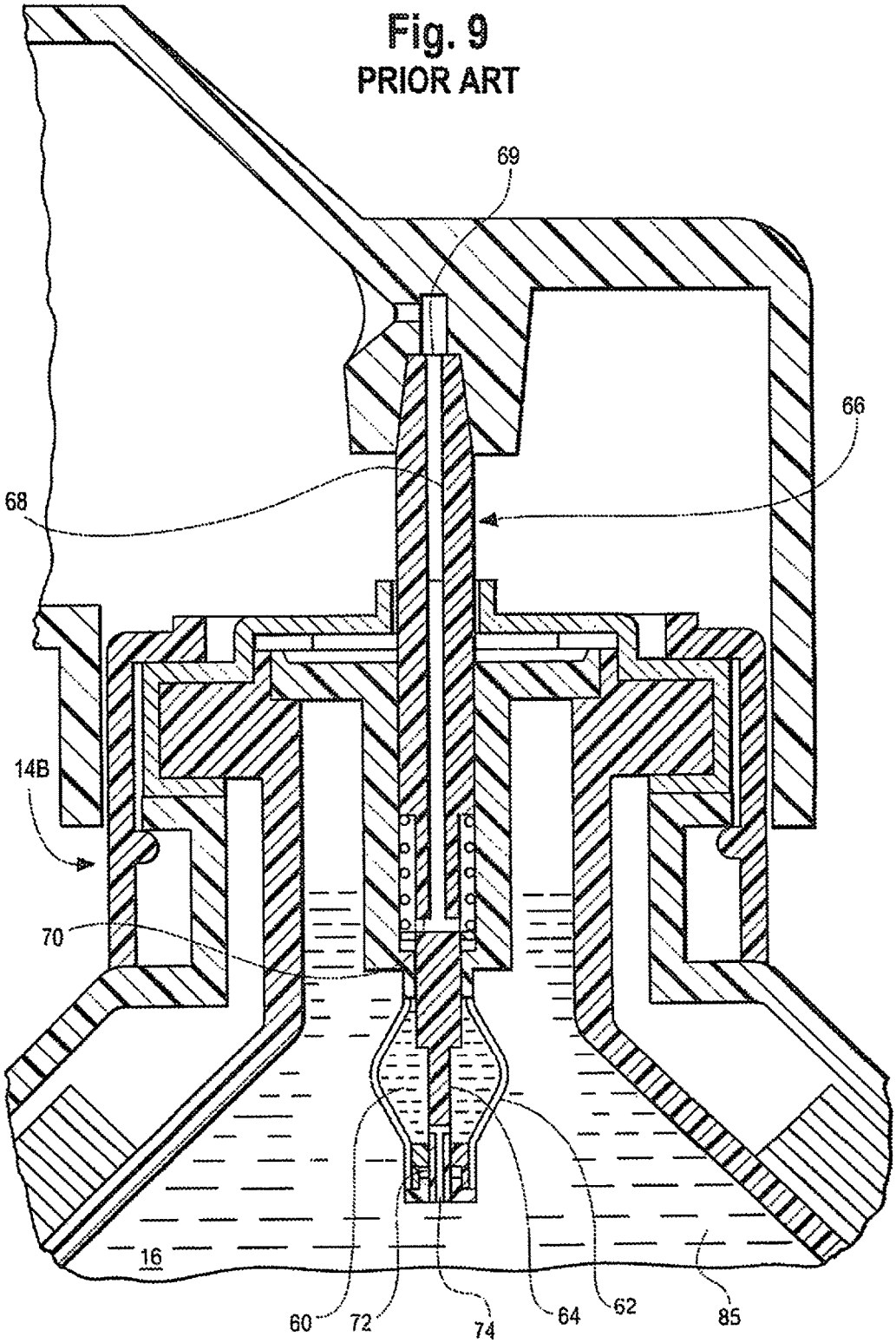
Fig. 9 PRIOR ART
FIG. 9 is a fragmentary cross-sectional view of another form of conventional valve having a stem in an elevated position and having a metering chamber shown in a "full" or "filled" condition.
Figure 10:
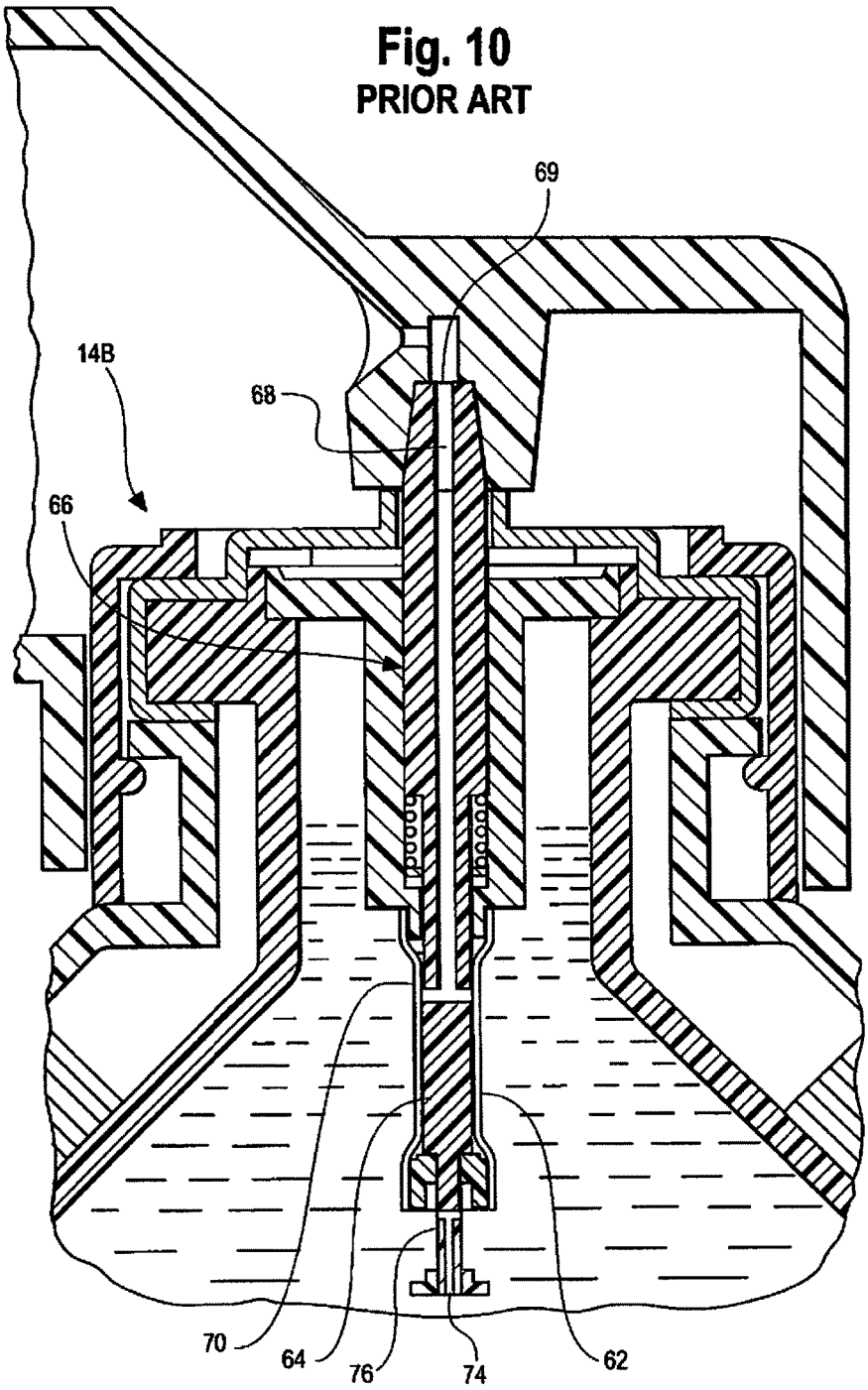
Fig. 10 PRIOR ART
FIG. 10 is another cross-sectional view of the valve illustrated in FIG. 9 but showing the stem being depressed and the metering chamber in an "empty" condition.

FIGS. 9 and 10 illustrate an alternative valve structure, generally indicated by reference numeral 14B. The valve structure 14B illustrated in FIGS. 9 and 10 embodies technology disclosed in my U.S. Pat. No. 4,892,232; the entirety of which is incorporated herein by reference. Valve 14B is designed to dispense a single adjustable dosage of liquid formulation upon each actuation of the valve 14B. The volume or amount of liquid formulation to be dispensed by valve 14B, however, is determined by the volume in a dispensing or metering chamber 60. In the embodiment illustrated by way of example in FIGS. 8 and 9, the dispensing or metering chamber 60 extends between an inner wall of a flexible membrane 62 and a lower body 64 of a vertically moveable stem 66.

In this embodiment, stem 66 defines a passageway 68 extending through the upper end of stem 66 from an opening 69 in the upper end and down to a port 70 disposed proximately midway along the length of stem 66. Another passageway 72, disposed toward a lower end of the stem 66, has one end opening at a distal end 74 of the stem 66. A second end of passageway 72 opens to a port 76 defined by stem 66 and is disposed a predetermined distance below port 70.

When the stem 66 of valve 14B is in an elevated position, as shown in FIG. 9, port 76 is positioned in the metering chamber 60 allowing liquid formulation to fill the chamber 60 and port 70 is withdrawn from chamber 60 thereby preventing the release of liquid formulation to the ambient. Depression or downward movement of the stem 66 to the position shown in FIG. 10, moves port 76 to the lower passage 72 and out of chamber 60 thereby preventing further liquid formulation 16 from entering the chamber 60. Depression or downward movement of the stem 66, to the position shown in FIG. 10, furthermore moves the upper port 70 into the metering chamber 60 thereby allowing the liquid formulation in the metering chamber 60 to be expelled to the ambient.

Figure 11:
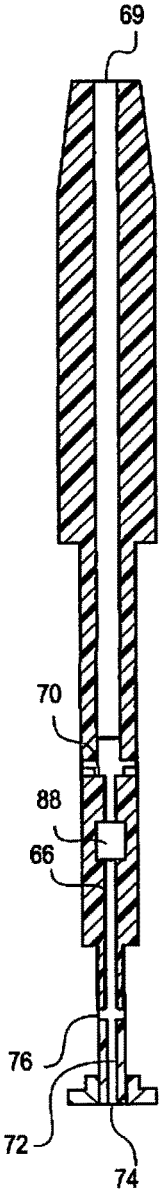
FIG. 11 is an enlarged cross-sectional view of another form of a valve stem which can be used in operable combination with a valve of the type shown in FIGS. 9 and 10 and which embodies teachings and principals of this invention disclosure.

As with valve 14A, and as shown in FIG. 11, valve 14B does not allow or promote the bag 18 in the container 12 to be filled or otherwise replenished with liquid formulation from an exterior of the container 12. Notably, however, valve 14B can be made to allow the bag 18 in the container 12 to be filled from outside the container 12 through a replacement stem 80 having an additional passage 86 that connects the upper passage 68 to the lower passage 72 defined by stem 80. Proximately midway along the length of the new passage 86 is a one-way valve 88 that permits liquid formulation to flow downwardly through the stem 80 and into bag 18 but does not permit liquid to flow from the lower end to the upper end and to be exhausted to the ambient.

Figure 12:
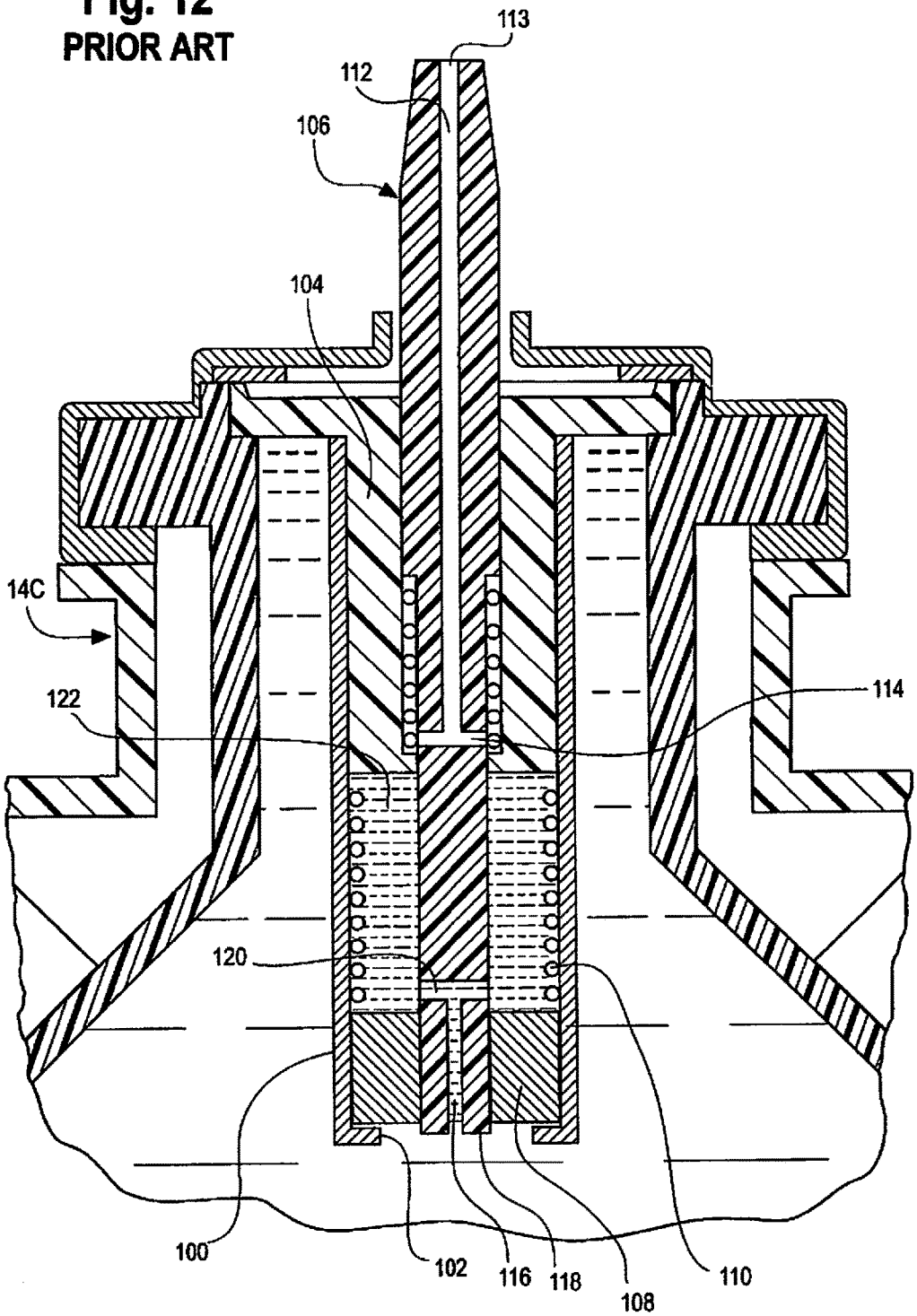
Fig. 12 PRIOR ART
FIG. 12 is a fragmentary cross-sectional view of another form of conventional valve having a stem in an elevated position and having a metering chamber shown in a "full" or "filled" condition.
Figure 13:
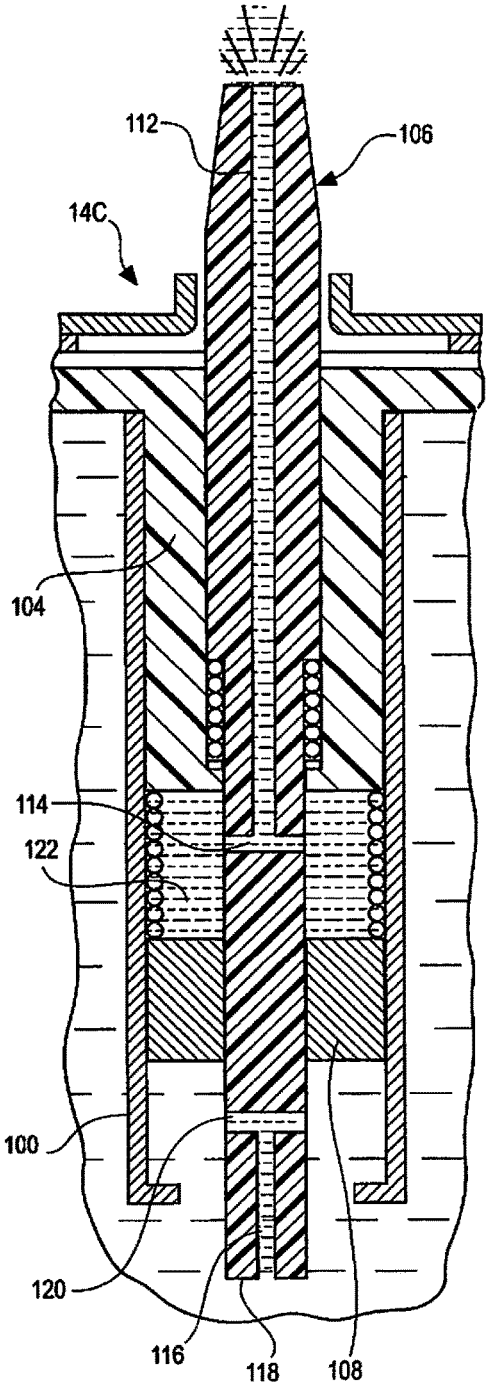
Fig. 13 PRIOR ART
FIG. 13 is a fragmentary cross-sectional view of the conventional valve shown in FIG. 12 with the stem in a depressed or lowered position and with a metering chamber shown in an "empty" or "exhausted" condition.

FIGS. 12 and 13 illustrate an alternative dispensing apparatus or device that does not employ a flexible members such as member 28 in that dispensing apparatus illustrated by way of example in FIG. 2 or the flexible member 62 in that dispensing apparatus illustrated by way of example in FIG. 9. In this alternative embodiment, illustrated by way of example in FIGS. 12 and 13, the dispensing apparatus includes a piston operated valve, generally indicated by reference numeral 14C. One example of a piston operated dispensing unit dose dispensing apparatus is described and depicted in my U.S. Pat. No. 5,183,187; the entirety of which is incorporated herein by reference. Only the elements of this dispensing apparatus that are relevant to the present invention disclosure are described herein, because the other elements of the dispensing apparatus are described in detail in my U.S. Pat. No. 5,183,187.

The piston operated valve structure 14C includes a tubular housing 100 having an inwardly directed flange 102 disposed toward a lower end thereof and a tubular plug 104 fitted in and toward an upper end thereof for slidably receiving an axially moveable stem 106. Between a lower surface of the plug 104 and the upwardly directed surface on flange 102 is an axially moveable piston 108 having an aperture therein for slidably receiving a lower end of the stem 106. Spring 110 urges the piston 108 in a direction away from the tubular plug 104 and against the radial flange 102. As such, a metering chamber 122 is defined between a lower surface of the plug 104 and an upper surface of the piston 108. Stem 106 defines an axial passage 112 extending from an upper end 113 and opens through a port 114 proximately midway along the length thereof. Spaced below the port 114 is a second lower passage 116 that extends from a lower end 118 of stem 106 to a second port 120 spaced a short distance below port 114.

When the stem 106 is in an elevated position, as shown in FIG. 12, the second port 120 opens into the metering chamber 122 and allows liquid formulation 16 to enter through the second passage 116 to fill the metering chamber 122. When the chamber 122 is filled with liquid formulation 16 and the stem 118 is depressed, as shown in FIG. 13, the lower port 120 of stem 106 is moved below the metering chamber 122 and the second port 114 defined by stem 118 is moved into the metering chamber 122 allowing the contents of chamber 122 to be released through the upper passage 112 to the ambient.

Figure 14:
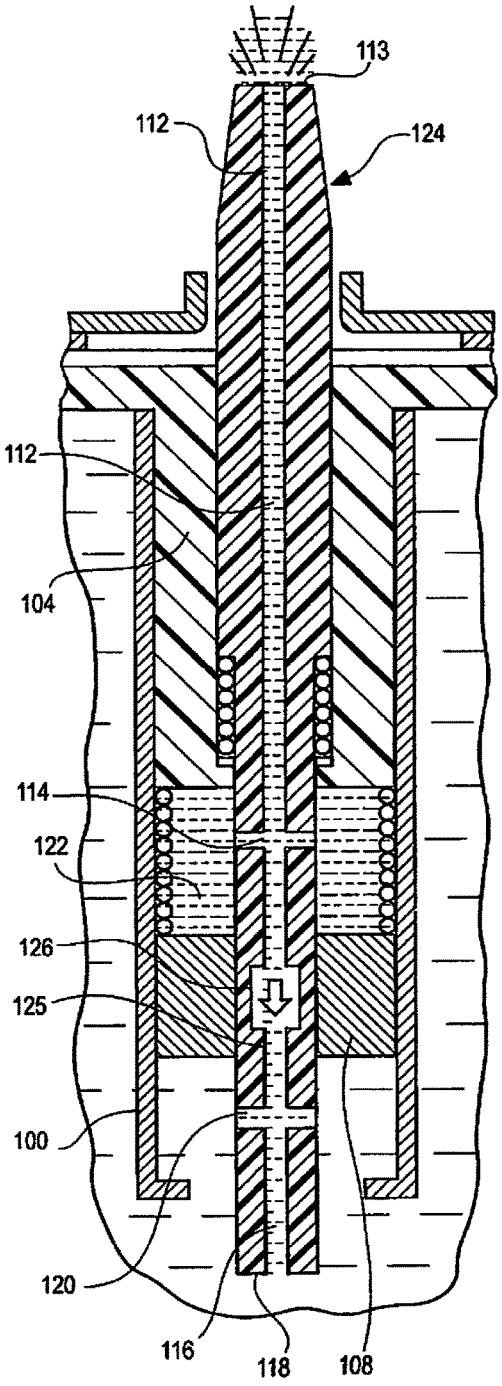
FIG. 14 is a fragmentary cross-sectional view of a valve of the type shown in FIGS. 12 and 13 but having a replacement stem embodying principals and teachings of this invention disclosure.

Referring now to FIG. 14, container 12, with the piston operated valve 14C, can advantageously be made refillable from outside the container 12 through the upper end 113 of a replacement stem 124. To effect these advantageous and desired ends, stem 124 defines a third passage 125 that connects the upper passage 112 to the lower passage 116. In one form, stem 124 is furthermore provided with a one-way valve 126 operably disposed between the upper passage 112 and the lower passage 116. The one-way valve 126 allows liquid formulation to flow from the upper passage 112 to the lower passage 116 and out the lower end 118 of stem 124 to thereby fill the bag 18 through stem 124. On the other hand, the one-way valve 126 operably prevents the liquid formulation in the bag 18 from being discharged through stem 124 except when the stem 124 is depressed and the valve 14C is operated in accordance with that disclosed in U.S. Pat. No. 5,183,187.

Without detracting or departing from the spirit and scope of this invention disclosure, this piston operated dispenser can be made in multiple variations. Specifically, and as shown by way of example in FIG. 15, the valve can be made such that rotation of the stem changes the length of movement of the piston within its tubular housing. The valve depicted in FIG. 15, and generally indicated by reference numeral 14D, is explained in greater detail as the second embodiment in my U.S. Pat. No. 5,183,187.

Figure 15:
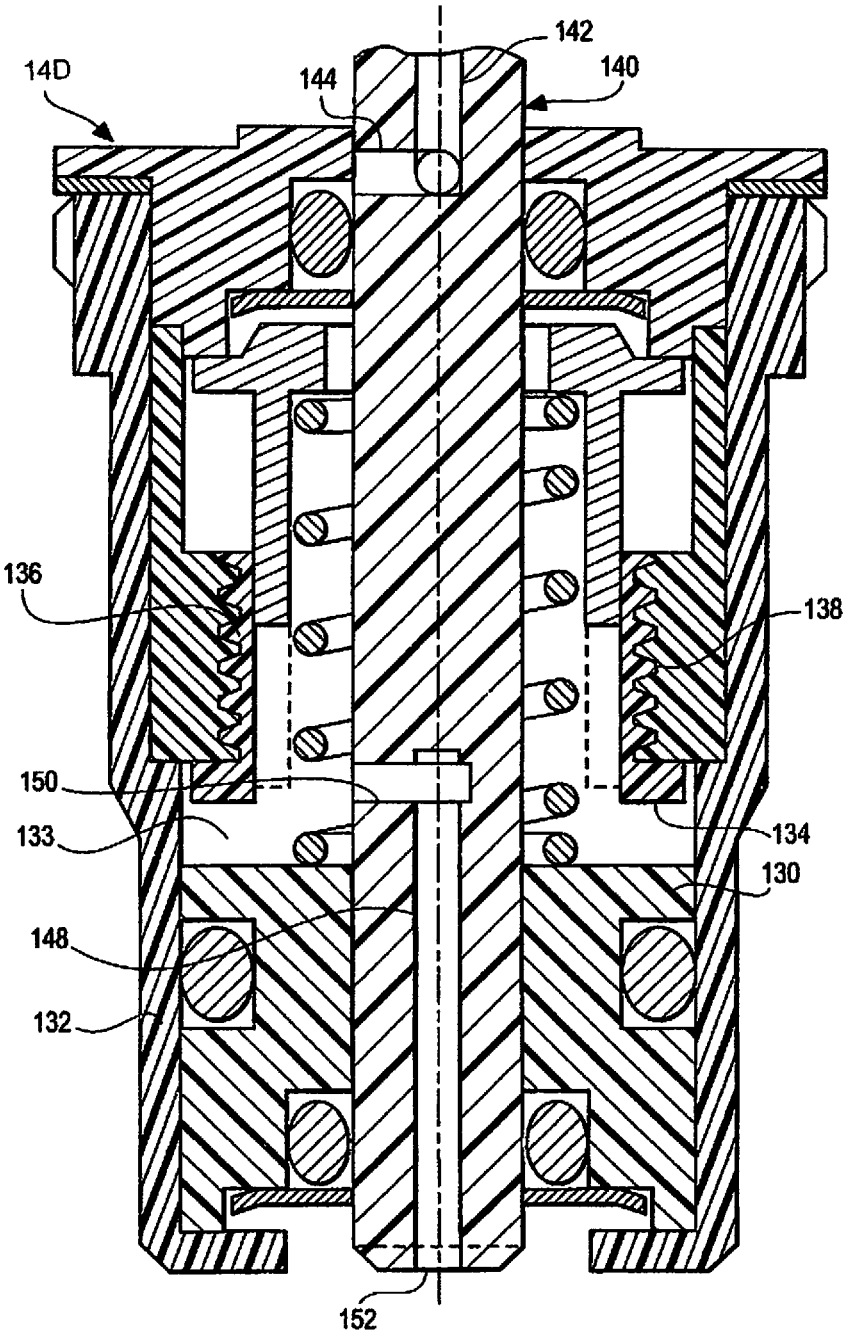
Fig. 15 PRIOR ART
FIG. 15 is a fragmentary cross-sectional view of another form of conventional valve having a stem in an elevated position and having a metering chamber shown in a "full" or "filled" condition.

In the embodiment illustrated by way of example in FIG. 15, a piston 130 is vertically moveable within and is operably sealed relative to a tubular housing 132 such that liquid formulation is prevented from passing therebetween. Stem 140 of valve 14D is vertically moveable through and is operably sealed relative to the piston 130 such that liquid formulation is prevented from passing therebetween. A metering chamber 133 is positioned above the piston 130 and upward movement of the piston 130 is limited by a lower surface 134 of a second sleeve 136 having an externally threaded outer surface 138. The external threads on the outer surface 138 of the second sleeve 136 engage complimentary threads on the inner surface of the tubular housing 132. In the illustrated embodiment, the second sleeve 136 is fixed for rotation with the stem 140 within the housing 132 but is capable of axial movement toward and away from piston 130. As will be understood, rotation of the stem 140 in one direction elevates the lower surface 134 of sleeve 136 and increases the length of the stroke of the piston 130 while rotation of the stem 140 in the other direction shortens the length of the stroke of the piston 130. In effect, rotation of the stem 140 of valve 14D, therefore, changes the volume of liquid formulation 16 that is discharged from valve 14D upon each actuation of the stem 140.

Notably, the stem 140 of valve 14D does not allow the container to be refilled with liquid formulation from outside the container. The stem 140 of valve 14D has an upper passage 142 extending from a port 144 disposed proximately midway along the length of stem 140 to the upper end thereof (not shown), and a lower passage 148 extending from a second port 150, positioned below port 144, to a bottom or lower end 152 of stem 140. When valve 14D is conditioned to not discharge liquid formulation therefrom, the lower port 140 is disposed within chamber 133. When the valve stem 140 is depressed to discharge liquid formation, however, port 150 is moved out of the chamber 133 just before the upper port 140 is moved into communication with chamber 133.

Figure 16:
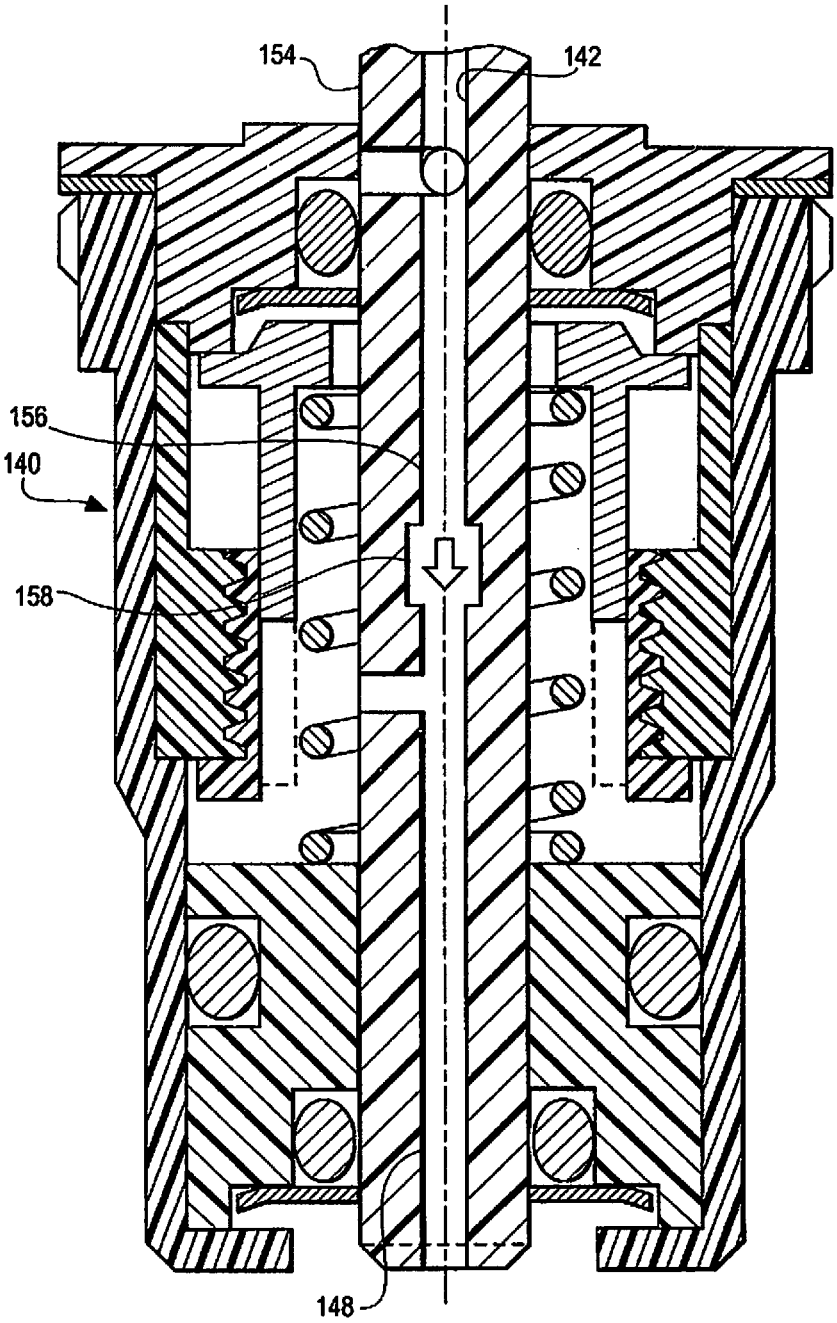
FIG. 16 is a fragmentary cross-sectional view of a valve of the type shown in FIG. 15 but having a replacement stem embodying principals and teachings of this invention disclosure.

As shown in FIG. 16, this Applicant recognized valve 14D can advantageously be redesigned, however, to allow the container to be refilled or replenished with liquid formulation from outside of the container through use of a replacement stem 154. As shown by way of example in FIG. 16, and like valve stem 140 discussed above, the valve stem 154 defines an upper passage 142 and a lower passage 148. The replacement valve stem 154, however, furthermore defines a connecting or fill passage 156 which fluidically joins the upper passage 142 with the lower passage 148 defined by stem 154. A one-way valve structure 158 is operably disposed in passage 156 to prevent liquid formulation from passing from the bag 18 from entering the lower passage 148 and passing through the connecting passage 156 to reach the upper port 146 and be exhausted to the ambient.

FIGS. 17 through 20 illustrate another piston operated dispensing apparatus or valve, generally indicated by reference numeral 14E. The dispensing apparatus 14E is of the type disclosed in my U.S. Pat. No. 6,695,175; the entirety of which is incorporated herein by reference. Valve 14E includes a metering chamber 160 disposed within a tubular housing 161. As with valves structures 14C and 14D, the metering chamber 160 of valve structure 14E is filled and discharged by means of an axially moveable piston 162. The volume of the metering chamber 160 is changed or modified by rotating an axially moveable stem 164. A float 165 rests on top of the piston 162 and rotates with stem 164. Projections 166, provided on and arranged toward an upper end of the float 165, contact portions of an irregularly shaped surface 170 to effectively change the stroke length of the piston 162.

Turning to FIGS. 19 and 20, the valve stem 164 has a relatively small diameter upper tubular portion 171 defining an upper passage 172 extending from a port 174, disposed proximately midlength of stem 164, and opening to an upper end 176 of stem 164 so as to provide an upper passage for discharging liquid formulation to the ambient. Stem 164 also has a relatively enlarged tubular lower portion 178 defining a central opening 179. A generally cylindrical wall toward the lower portion 178 of stem 164 defines a slot 180 extending from the bottom of the stem 164 to proximately midlength of the lower portion 178 of stem 164. As illustrated by way of example in FIG. 17, the slot 180 allows liquid formulation to fill the metering chamber 160 through a side port 182 in the housing 161 when the stem 164 is in an elevated or raised position or condition. When the stem 164 is depressed, as shown in FIG. 18, the generally cylindrical wall of the stem 164 effectively blocks the side port 182 and moves port 174 of stem 164 into the metering chamber 160. The piston 162 is then urged upward by the propellant in the container to discharge liquid formulation 16 in the metering chamber 160 through the upper passage 172 to the ambient.

The valve illustrated by way of example in FIGS. 17 through 20 does not permit the container to be refilled or replenished with liquid formulation from outside the container. As shown in FIG. 21, this Applicant recognized valve 14E can advantageously be redesigned, however, to allow the container to be refilled or replenished with liquid formulation from outside of the container through use of a replacement stem 183. The valve replacement stem 183 defines an additional fill passage 184 having an upper end, disposed in fluid communication with the discharge passage 172, and a lower end, disposed in fluid communication with the generally centralized opening 179 disposed in the lower tubular portion 178 of stem 164.

In the illustrated embodiment, a one-way valve structure, in the form of a reed valve or flexible flap 186, is disposed in the central opening 178 defined by the replacement stem 183 in operable combination with the lower end of the fill passage 184 to prevent passage of liquid formulation to the discharge passage 172 except when the bag 18 is to be refilled or replenished with liquid formulation from outside of the container. That is, the fill passage 184 in the modified valve stem 183 permits pressurized fluid formulation to be injected into the upper passage 172 of the valve stem 183 to pass through the one-way valve to the bag in the container to thereby fill, refill and/or replenish the bag 18 while preventing liquid formulation in the bag from escaping through the passage 184 to the ambient.

Figure 17:
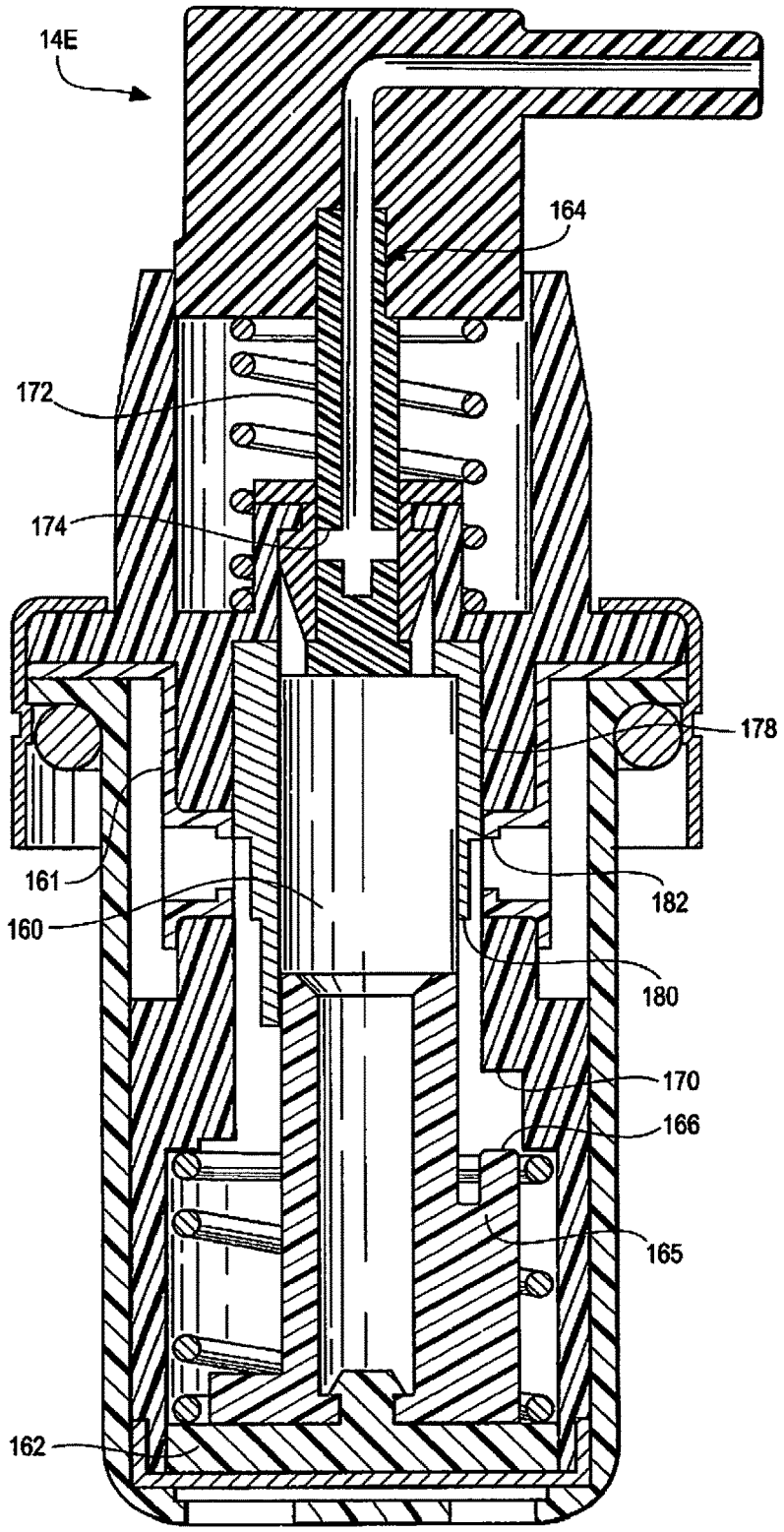
Fig. 17 PRIOR ART
FIG. 17 is a fragmentary cross-sectional view of still another alternative form of conventional valve having a stem in an elevated position and having a metering chamber shown in a "full" or "filled" condition.
Figure 18:
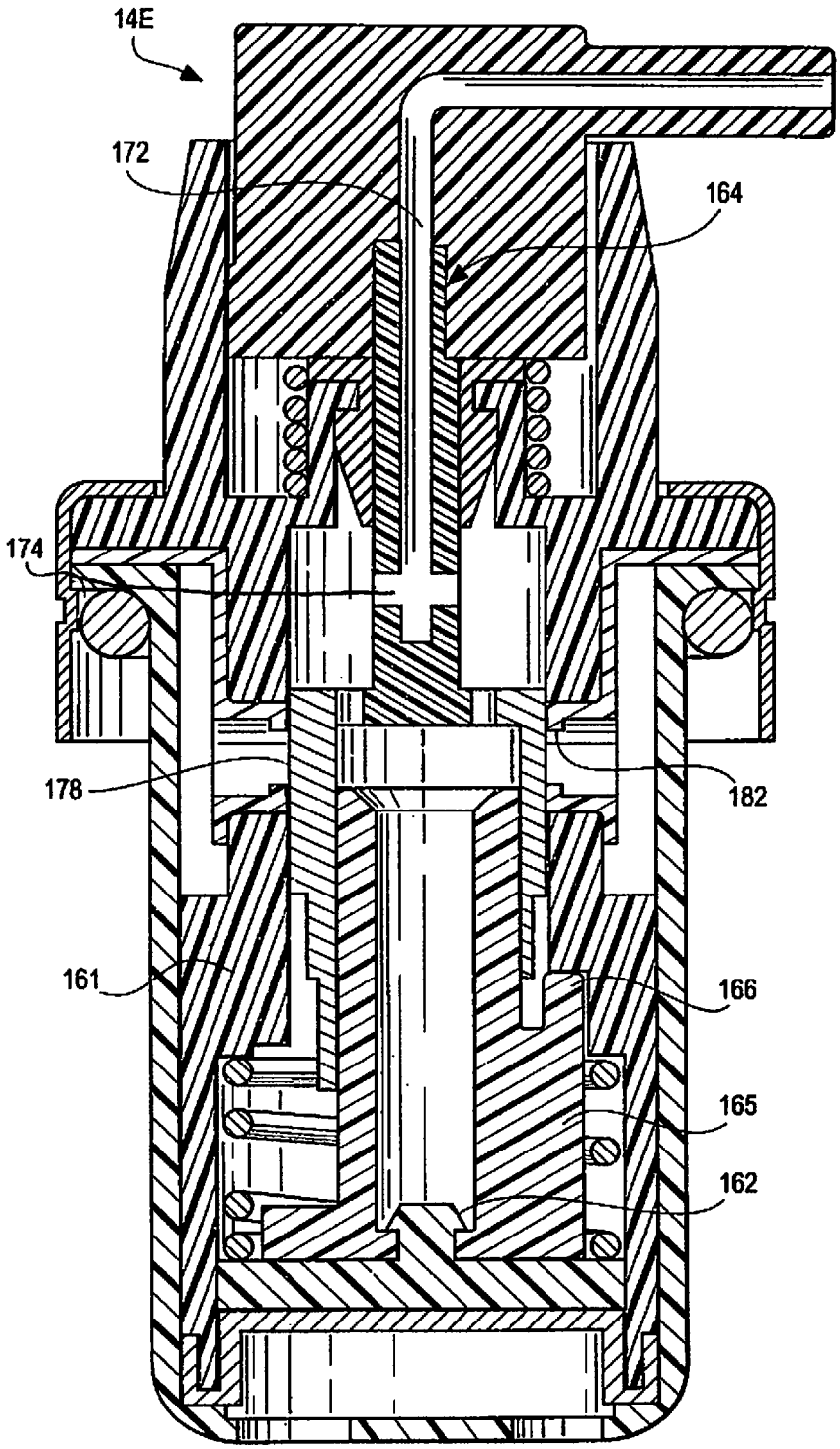
Fig. 18 PRIOR ART
FIG. 18 is a fragmentary cross-sectional view of the conventional valve shown in FIG. 17 with the stem in a depressed or lowered position and with a metering chamber shown in an "empty" or "exhausted" condition.
Figure 22:
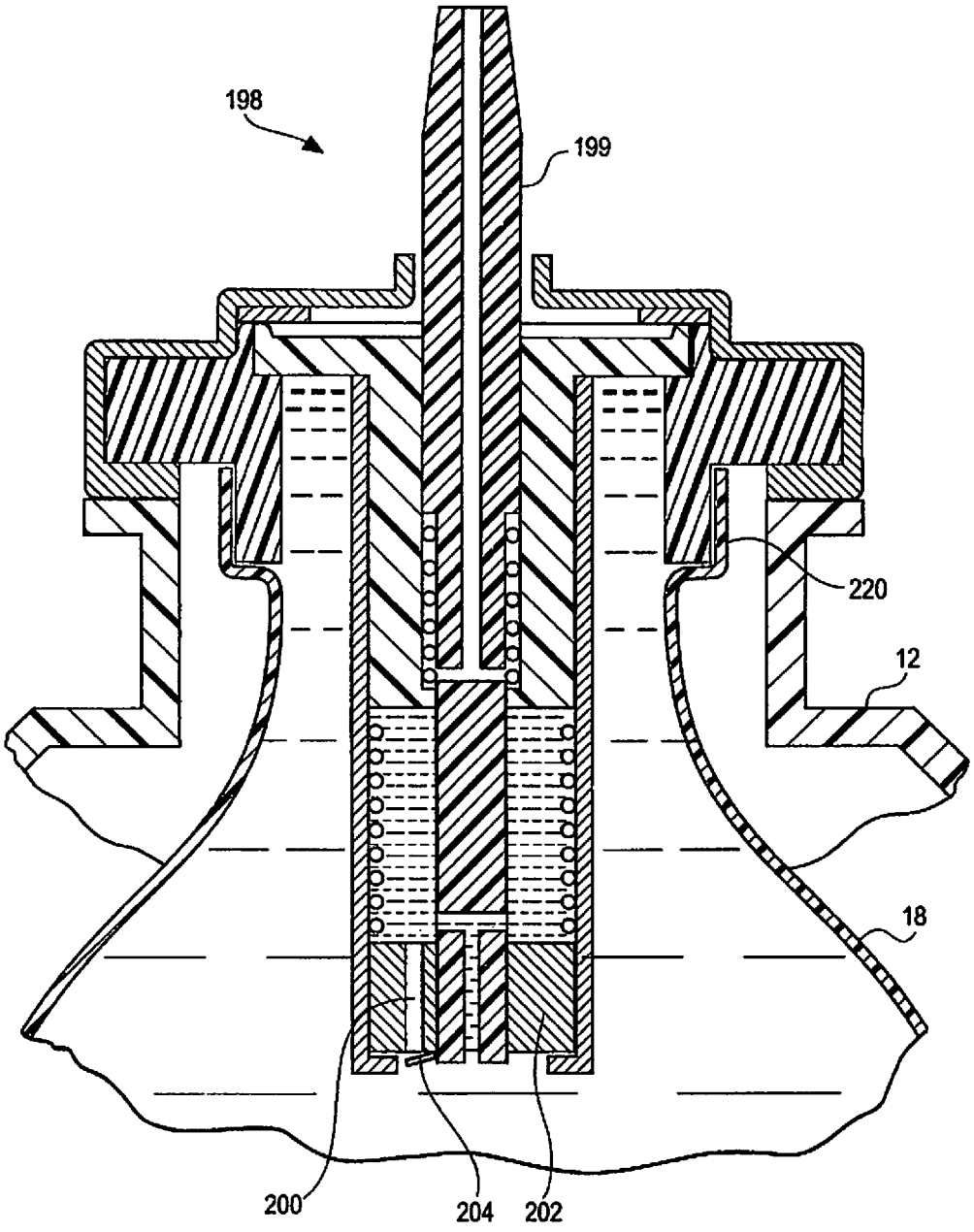
FIG. 22 is a fragmentary cross-sectional view of a conventional piston operated valve having a stem similar to that shown in FIG. 12 but having principals and teachings of this invention disclosure applied to the piston.

FIG. 22 illustrates another piston operated dispensing apparatus, generally indicated in FIG. 22 by reference numeral 198, which operates in a manner similar to those devices illustrated in FIGS. 12, 15 and 17. Like those piston operated structures illustrated in FIGS. 14, 16 and 17, the dispensing apparatus 198 in FIG. 22 is also fillable and/or refillable through the valve stem 199 and from outside of the container 10. To affect these desired ends, the piston 202 defines a fill passage 200 which, in the illustrated embodiment, extends through a body of the piston 202. An upper end of the fill passage 200 opens to the metering chamber (122 in FIG. 12, 133 in FIG. 15 and 160 in FIG. 17) while a lower end of the fill passage 200 opens to the bag 18. A one-way valve 204 is arranged in operable combination with the piston 202 and is operably disposed between the opposed ends of the fill passage 200. The one-way valve 204 prevents fluid from passing from the bag 18 into the respective metering chamber. In the illustrated embodiment, the one-way valve structure is shown as a flap or reed valve but it should be appreciated any suitable one-way valve structure for affecting the desired ends would equally suffice without detracting or departing from the spirit and scope of this invention disclosure.

To fill and/or refill the bag 18 of the piston operated apparatus illustrated by way of example in FIG. 22, the stem 199 must be depressed such the discharge passage of the valve stem 199 is open to the metering chamber. Accordingly, and with the valve stem depressed, pressurized liquid formulation may be injected from outside the container and into the discharge nozzle of the valve (valve 106 in FIG. 12, valve 14D in FIG. 15, and valve 14E in FIG. 17) causing i5 to flow into the metering chamber, through the fill passage 200 defined by the body of piston 202 defining such passage and into the bag 18. As will be understood, the one-way valve 204 will act to prevent pressurized liquid in the bag 18 from passing through the passage 200 in the piston 202 and back into the metering chamber.

Figure 23:
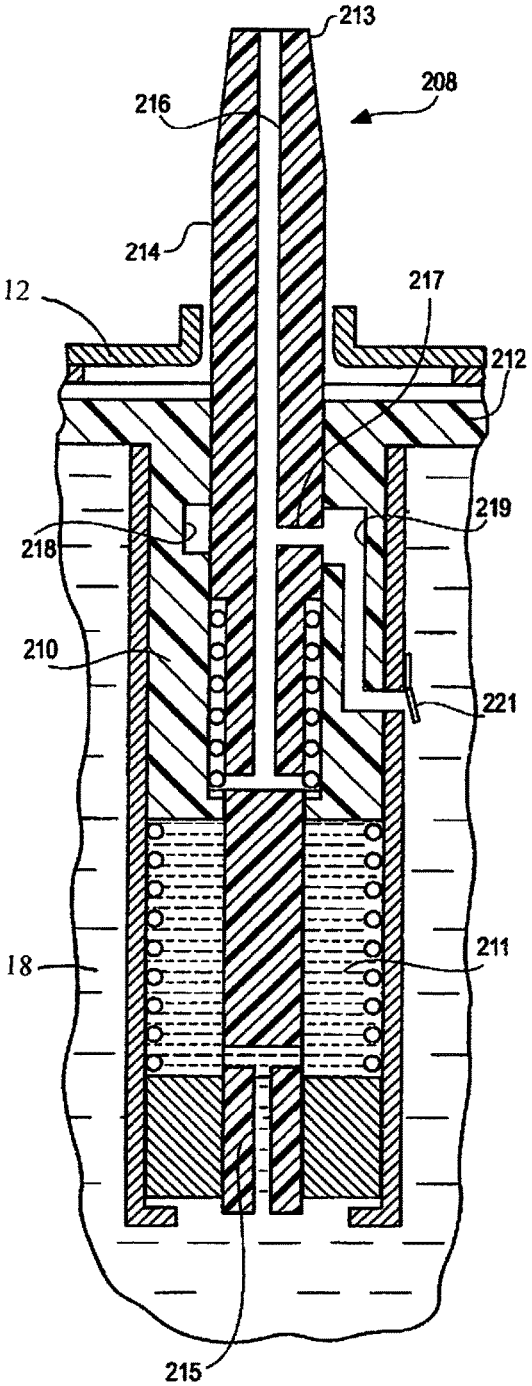
FIG. 23 is a fragmentary cross-sectional view of another conventional piston operated valve having a stem similar to that shown in FIG. 12 but having principals and teachings of this invention disclosure applied to the valve.

FIG. 23 illustrates still another piston operated dispensing apparatus, generally indicated in FIG. 23 by reference numeral 208, which operates in a manner similar to those devices illustrated in FIGS. 12, 15 and 17. The valve structure for the dispensing apparatus 208, illustrated by way of example in FIG. 23, includes a tubular body 210. A lower end of the tubular body 210 extends into the container 12 and the bag 18. An upper end of the tubular body 210 includes an annular flange 212 adapted to be retained against a mouth of the container 12. The tubular body 210 defines an elongated generally centralized opening which accommodates, for endwise sliding movements, an axially elongated depressible actuator stem 214. In the illustrated embodiment, the actuator stem 214 is a tubular member having a dispensing nozzle (not shown) operably associated with an upper end 213 hereof. Toward a lower end 215, the actuator stem 214 defines suitably configured passages which are configured and adapted to fill a metering chamber 211 such that the dispensing apparatus 208 dispenses a fixed volume of liquid formulation on each actuation of the apparatus 208 such as provided by any one of the types of dispensing valves described above.

As illustrated by way of example in FIG. 23, the actuator stem 214 has a longitudinal discharge bore or passageway 216 which opens to an upper end of the stem 214 and through which liquid formulation is discharged. When the stem 214 is in a raised position, as shown in FIG. 23, the discharge bore or passageway 216 is closed off from the metering chamber 211. As such, and with the valve stem 214 in a raised or elevated position, it should be appreciated, liquid formulation injected into an upper or discharge end 216 of the valve stem 214 will not and cannot reach the metering chamber 211. Accordingly, bag 18 cannot be filled/refilled and/or replenished with liquid formulation from outside of the container.

This Applicant recognized how a valve as described above and illustrated in FIG. 23 can advantageously be redesigned, to allow the container to be refilled or replenished with liquid formulation from outside of the container. In accordance with this invention disclosure, and along the length of stem 214, at a position below the annular flange 212, stem 214 has been redesigned to define a radial bore or opening 217 extending between an outer circumference of the stem 214 and opening to the discharge bore or passageway 216. Moreover, the tubular body 210, through which stem 214 passes, preferably defines an annular recess or groove 218. As long as the stem 214 is in an elevated position, and as shown in FIG. 23, the radial bore or opening 217 defined by the stem 214 is axially aligned with and opens to the annular groove or recess 218. In the preferred embodiment, a fill passage 219 extends from the annular groove or recess 218 and opens to an exterior of the tubular body 210 and to the bag 18 in axially spaced relation from the annular flange 212 such that liquid formulation in the bag 18 can pass unencumbered or unobstructedly into the passage 219.

A one-way valve 221 is arranged in operable association with the tubular member 210 and, more specifically, with that end of the fill passage 219 opening to the exterior of the tubular member 210 and to the bag 18. The one-way valve 221 prevents fluid from passing from the bag 18 into the passage 219. In the illustrated embodiment, the one-way valve 221 is shown as a flap or reed valve but it should be appreciated any suitable one-way valve structure for affecting the desired ends would equally suffice without detracting or departing from the spirit and scope of this invention disclosure.

From the illustration in FIG. 23 showing the valve stem 214 in a raised or elevated position, it should be appreciated, once the bag 18 is filled with liquid formulation pressure from the propellant surrounding bag 18 will apply a force to the one-way valve 221 in a manner releasably maintaining the valve structure 221 in a closed position or condition. Also, liquid formulation released from the discharge passage 216 will not flow back into the bag 18 through the annular groove 218 and passageway 219 because the pressure of the liquid formulation being discharged is less than the pressure within and being exerted on the bag 18.

Figure 24:
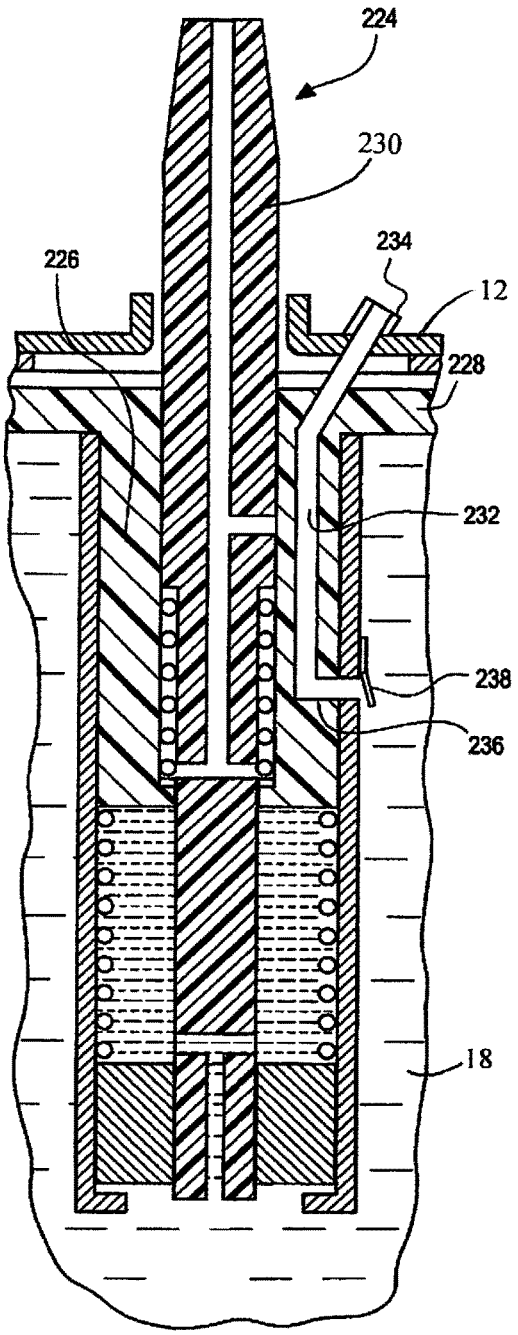
FIG. 24 is a is a fragmentary cross-sectional view of still another conventional piston operated valve having a stem similar to that shown in FIG. 12 but having principals and teachings of this invention disclosure applied to the valve

FIG. 24 illustrates another metering dispensing valve, generally indicated by reference numeral 224. In this alternative embodiment, the bag 18 of the metering valve can advantageously be filled from an exterior of the container 12 and through a port that is independent of the valve actuator and the discharge passage defined thereby. In this alternative embodiment, valve 224 includes a tubular body 226 a lower end of which extends into the container 12 and the bag 18. An upper end of the tubular body 226 includes an annular flange 228 adapted to be retained against a mouth of the container 12, The tubular body 226 defines an elongated generally centralized opening which accommodates, for endwise sliding movements, an axially elongated depressible actuator stem 230. In the illustrated embodiment, the actuator stem 230 is a tubular member having a dispensing nozzle (not shown) operably associated with an upper end thereof. Toward a lower end, the actuator stem 230 defines suitably configured passages which are configured and adapted to fill a metering chamber such that the dispensing apparatus 224 dispenses a fixed volume of liquid formulation on each actuation of the apparatus such as provided by any one of the types of dispensing valves described above.

As with the embodiment illustrated in FIG. 23, the actuator stem 230 has a longitudinal discharge bore or passageway which opens to an upper end of the stem 230 and through which liquid formulation is discharged. When the stem 230 is in a raised position, as shown in FIG. 24, the discharge passage of stem 230 is closed off from the metering chamber of the valve. As such, and with the valve stem 230 in a raised or elevated position, it should be appreciated, liquid formulation injected into an upper or discharge end of the valve stem 230 will not and cannot reach the metering chamber. Accordingly, the bag 18 cannot be filled/refilled and/or replenished with liquid formulation from outside of the container.

This Applicant recognized how a valve as described above and illustrated in FIG. 24 can advantageously be redesigned, to allow the container to be refilled or replenished with liquid formulation from outside of the container. In accordance with this invention disclosure, the tubular body 226 defines a fill passage 232 therein. An upper end of the fill passage 232 opens preferably toward an upper exterior of the container 12 and it fitted with a conventional and well known filling port 234. A lower end 236 of the fill passage 232 opens inside the bag 18.

A one-way valve 238 is arranged in operable association with the tubular member 232. In the illustrated embodiment, the one-way valve 238 is disposed in operable combination with fill passage 226 and, more specifically, operably between the filling port 234 and the lower end 236 of the fill passage 219 opening to the interior of bag 18. The one-way valve 238 operably permits liquid formulation to flow from the filling port 234 toward the bag 18 while operably preventing liquid formulation from passing from the bag 18 into the fill passage 226. In the illustrated embodiment, the one-way valve 226 is shown as a flap or reed valve but it should be appreciated any suitable one-way valve structure for affecting the desired ends would equally suffice without detracting or departing from the spirit and scope of this invention disclosure.

In the embodiment illustrated in FIG. 24, wherein the actuator stem 230 is shown in a raised or elevated position, it should be appreciated, once the bag 18 is filled with liquid formulation, pressure from the propellant surrounding bag 18 will apply a force to one-way valve 238 in a manner releasably maintaining the valve 238 in a closed position or condition. Also, liquid formulation released from the passage 226 will not flow back into the bag 18 because the pressure of the liquid formulation in the passage is likely less than the pressure within and being exerted on the bag 18.

All the illustrated embodiments of the present invention disclosure provide a dispensing apparatus with a fill passage that beneficially allows the bag 18 to be filled with pressurized liquid formulation from outside of the container. Moreover, the various illustrated embodiments of the present invention disclosure provide a dispensing apparatus with a fill passage that advantageously allows the bag 18 to be filled with liquid formulation following the metering valve, in whatever form, and bag 18 been assembled to the container and the container 12 has been pressurized with a propellant.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A dispensing device, comprising:

a container having an aperture, a discharge valve in said aperture, with said discharge valve including a dispensing structure for dispensing a volume of liquid formulation on each actuation of said valve, with said discharge valve having an axially moveable stem with an upper portion extending to ambient and a lower portion extending within said container, and wherein the stem of said discharge valve defines a discharge passage opening to ambient;

a bag in said container, said bag enclosing said lower portion of said discharge valve, a propellant surrounding said bag such that said propellant provides pressure within said bag, a liquid formulation in said bag, with said discharge valve further defining a fill passage arranged independent of said discharge passage defined by said stem, with an upper end of said fill passage opening to an exterior of said container and is fitted with a filling port and with a lower end of said fill passage opening to said bag, and a one-way valve disposed in operable combination with said fill passage for allowing liquid formulation to flow through said fill passage from outside said container and into said bag while preventing liquid formulation in said bag flowing through said fill passage to said ambient whereby permitting said bag to receive said liquid formulation through the fill passage from outside of said container.

2. The dispensing device of claim 1 wherein said one-way valve is a flap operably disposed to prevent the liquid formulation in said bag from entering said fill passage.

3. The dispensing device of claim 1 and further comprising:

said discharge valve including a metering chamber for discharging a predetermined amount of liquid formulation on each actuation of said valve.

4. The dispensing device of claim 1 wherein said discharge passage includes an aperture in a wall of said stem.

5. The dispensing device of claim 1 wherein said discharge valve has a moveable piston forming a wall of said metering chamber.

6. The device of claim 5 wherein said fill passage includes a passage through said piston.

7. A dispensing device, comprising:

a container having an aperture, a discharge valve in said aperture, said discharge valve including a dispensing structure for dispensing a volume of liquid formulation on each actuation of said valve, with said discharge valve having an axially moveable stem with an upper portion extending to ambient and a lower portion extending within said container, with said stem defining a discharge passage opening to ambient, and wherein said discharge valve is a metering valve for dispensing a predetermined volume of liquid formulation on each actuation of said valve, and with said stem being rotatable for changing said predetermined volume of liquid formulation to be dispensed, a bag in said container, said bag enclosing said lower portion of said discharge valve, a propellant surrounding said bag such that said propellant provides pressure within said bag, a liquid formulation in said bag, a fill passage defined by the discharge valve independent of the discharge passage defined by said stem, with said fill passage opening at a first end to an exterior of said container and opening at second end to said bag, with said fill passage having a filling port at the first end thereof, and a one-way valve disposed in operable combination with said fill passage, wherein said one-way valve allows liquid to flow through said fill passage from said ambient into said bag and prevents liquid formulation in said bag flowing through said fill passage to ambient whereby permitting said bag to receive said liquid formulation through the fill passage from outside of said dispensing device.

8. The dispensing device of claim 7 wherein said one-way valve is a flap operably disposed to prevent liquid formulation in said bag from entering said fill passage.

9. The dispensing device of claim 7 wherein said discharge passage includes an aperture in a wall of said stem.

10. The dispensing device of claim 7 wherein said discharge valve has a moveable piston forming a wall of a metering chamber, with said fill passage including a passage through said piston.

11. The dispensing device according to claim 10 wherein a volume of said metering chamber is adjustable in response to rotation of said stem.

12. In a dispensing device for dispensing a volume of liquid formulation, said device including a container having an aperture, a discharge valve in said aperture, said discharge valve having a moveable stem defining a discharge passage having an upper portion extending outside of said container to ambient, with said discharge valve further including a piston arranged toward a lower end of said discharge valve so as to define part of a metering chamber, a bag in said container, wherein said bag encloses the lower portion of said dispensing valve, a propellant surrounding said bag, and a liquid formulation in said bag, wherein said discharge valve has the improvement comprising:

a fill passage defined by said piston independent of said discharge passage and extending between the metering chamber and said bag, and a one-way valve disposed in operable combination with said fill passage for preventing liquid from within said bag from passing through said fill passage to said ambient and allowing said bag to be filled with liquid formulation from outside said dispensing device.

13. The improvement of claim 12 wherein said one-way valve is a flap that extends across an aperture to prevent liquid from entering said fill passage from said bag.

14. The improvement of claim 12 wherein said discharge passage includes an aperture in a wall of said stem.

15. A method for filling a dispensing device including a container having an aperture, a discharge valve in said aperture, said discharge valve including a dispensing structure for dispensing a volume of liquid formulation on each actuation of said discharge valve, said dispensing structure including an axially moveable stem with an upper portion defining a discharge passage opening to ambient and a lower portion extending within a bag in said container, a propellant surrounding and providing pressure within said bag, a liquid formulation in said bag, said method comprising the steps of:

configuring said discharge valve with a fill passage that is independent of said discharge passage and opens to said bag; and preventing liquid formulation in said bag from flowing through said fill passage to ambient whereby allowing said bag to be filled with said liquid formulation from outside said dispensing device.

16. The method according to claim 15 further comprising the step of:

configuring said discharge valve to control the volume of liquid formulation dispensed from said dispensing device upon rotation of said stem.

17. The method according to claim 15 further comprising the step of:

providing said discharge valve with a metering chamber such that said discharge valve discharges a predetermined amount of liquid formulation on each actuation of said discharge valve.

* * * * *